United States Patent [19]

Ishii et al.

[11] Patent Number: 4,624,032

[45] Date of Patent: Nov. 25, 1986

[54] SLIDE FASTENER SLIDER WITH DETACHABLE PULL TAB

[75] Inventors: Susumu Ishii, Kurobe; Kiyoshi Oda, Namerikawa, both of Japan

[73] Assignee: Yoshida Kogyo K. K., Tokyo, Japan

[21] Appl. No.: 784,151

[22] Filed: Oct. 4, 1985

[30] Foreign Application Priority Data

Oct. 16, 1984 [JP] Japan ..... 59-156098[U]

[51] Int. Cl.[4] ..... A44B 19/26

[52] U.S. Cl. ..... 24/429; 24/419; 24/437

[58] Field of Search ..... 24/429, 437, 419, 236, 24/237

[56] References Cited

U.S. PATENT DOCUMENTS

| | | | |
|---|---|---|---|
| 1,899,529 | 2/1933 | Rutherford | 24/429 |
| 2,865,075 | 12/1958 | Firing et al. | 24/419 |
| 3,018,534 | 1/1962 | Huelster | 24/419 |
| 3,820,203 | 6/1974 | Takamatsu | 24/419 |
| 3,955,248 | 5/1976 | Akashi | 24/429 |
| 4,525,903 | 7/1985 | Ishii | 24/429 |

FOREIGN PATENT DOCUMENTS

| | | | |
|---|---|---|---|
| 170466 | 2/1952 | Australia | 24/429 |
| 2907232 | 9/1979 | Fed. Rep. of Germany | 24/429 |
| 57-99413 | 6/1982 | Japan . | |
| 58-165805 | 9/1983 | Japan . | |
| 2117042 | 10/1983 | United Kingdom | 24/429 |

*Primary Examiner*—Victor N. Sakran

*Attorney, Agent, or Firm*—Hill, Van Santen, Steadman & Simpson

[57] ABSTRACT

A slide fastener slider has an arch-shaped lug projecting from the top surface of an upper wing and terminating in a rear free end spaced from the top surface of the upper wing by a predetermined gap. A slide is slidably mounted in the upper wing and has a closure projection. The slide is movable between an open position in which the closure projection is spaced from the free end of the lug to open the gap for allowing the pintle of a pull tab to pass therethrough, and a closed position in which the closure projection is disposed adjacent to the free end of the lug to close the gap for preventing the pintle of the pull tab from passing therethrough. The slide is normally urged to its closed position by a spring mounted in the upper wing.

7 Claims, 7 Drawing Figures

SLIDE FASTENER SLIDER WITH DETACHABLE PULL TAB

BACKGROUND OF THE INVENTION

1. Field of the Invention

The present invention relates to slide fasteners, and more particularly to a slide fastener slider having a detachable pull tab.

2. Description of the Prior Art

Japanese Utility Model Laid-Open Publication (Jikkaisho) 57-99413 and Japanese Patent Laid-Open (Tokkaisho) 58-165805 disclose slide fastener sliders having detachable pull tabs.

In the slider disclosed in Japanese Utility Model Laid-Open Publication 57-99413, a pull tab retainer disposed on the top of a slider body has a central portion divided into two sections, one of which is pivotally movable to open and close the retainer and is normally biased to its closed position by a spring. However, the split or separation in the central portion of the retainer is conspicuous and hence mars the appearance of the slider.

In the slider disclosed in Japanese Patent Laid-Open Publication 58-165805, a pull tab retainer includes an arch-shaped lug disposed on the top of a slider body and having a free end spaced therefrom by a gap, and a wire spring supported on the lug or the slider body so as to retractably project into the gap to open and close the pull tab retainer. This prior art slider has no problem so far as attachment and removal of the pull tab and appearance are concerned. After the pull tab has been attached, however, the spring is engageable with the pintle of the pull tab, thus making the pull tab non-stable when it is pulled. Further, in assembling the slider, the spring has to be forcibly compressed or deformed when it is inserted into the gap. The spring is therefore liable to be excessively deformed so that its initial shape can no longer be restored after the assembly. Thus, easy and accurate mounting of the spring is difficult to achieve.

SUMMARY OF THE INVENTION

According to the present invention, a slide fastener slider has an arch-shaped lug projecting from the front end of an upper wing over the top surface of the upper wing toward the rear end thereof and terminating in a free end spaced from the top surface of the upper wing by a gap. A slide is slidably mounted in the upper wing and has a closure projection. The slide is movable between an open position in which the closure projection is spaced from the free end of the lug so as to allow a pull tab to be threaded onto and removed from the lug, and a closed position in which the closure projection is disposed adjacent to the free end of the lug to prevent the pull tab from being removed from the lug. A spring is mounted in the upper wing to normally urge the closure member to its closed position.

It is therefore an object of the present invention to provide a slider with a detachable pull tab which slider is neat in appearance.

Another object of the invention is to provide a slider in which a detachable pull tab can maintain its proper orientation even when it is pulled.

A further object of the invention is to provide a slider with a detachable pull tab in which slider the individual components of a pull tab retainer can maintain their proper postures after the slider has been assemblied, thus enabling automated assembling.

Many other advantages, features and additional objects of the present invention will become manifest to those versed in the art upon making reference to the detailed description and the accompanying drawings in which two preferred embodiments incorporating the principles of the present invention are shown by way of illustrative example.

DETAILED DESCRIPTION

Figure 1:
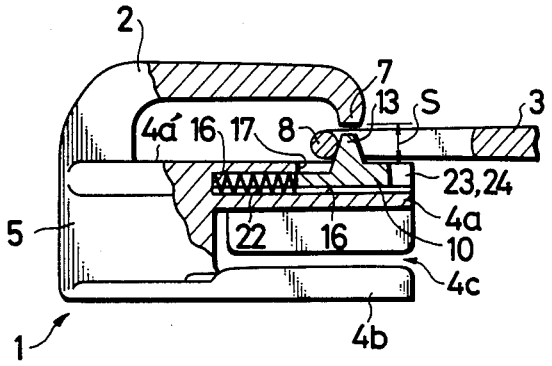
FIG. 1 is a side elevational view, partially broken away, of a slider embodying the present invention.
Figure 2:
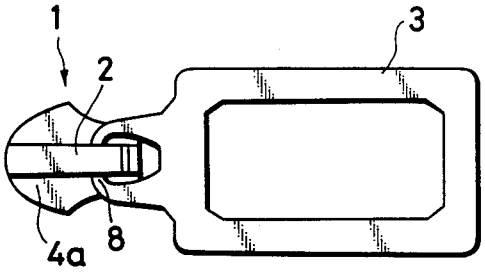
FIG. 2 is a plan view, on a reduced scale, of FIG. 1.

FIGS. 1 and 2 show a slider 1 having a detachable pull tab 3. The slider 1 comprises a slider body including upper and lower wings 4*a*, 4*b* joined at their front end by a neck 5 so as to define a generally Y-shaped guide channel 4*c* for the passage of a pair of opposed coupling element rows of a slide fastener (not shown).

The slider body is made by die casting and has an arch-shaped lug 2 integral therewith and disposed on the top surface 4*a*′ of the upper wing 4*a*. The arch-shaped lug 2 extends from the front end of the upper wing 4*a* over the top surface 4*a*′ of the upper wing 4*a* and terminates in a downwardly directed rear free end 7 spaced from the top surface 4*a*′ of the upper wing 4*a* by a predetermined gap S larger than the diameter of a spindle 8 of the pull tab 3.

The slider body has a guide bore 16 extending longitudinally in the upper wing 4*a* from its rear end and terminating short of its front end. A slide 10 having a closure projection 13 is slidably received in the guide bore 16 with the closure projection 13 directed upwardly. The slide 10 is movable in the guide bore 16 between an open position (FIG. 3) in which the closure projection 13 is spaced from the free end 7 of the lug 2 toward the front end of the slider body by a predetermined distance enough to allow the pull tab 3 to be threaded onto the lug 2 and removed therefrom, and a closed position (FIG. 1) in which the closure projection 13 is disposed adjacent to the free end 7 of the lug 2 in vertical aligned therewith to prevent the pull tab 3 from being removed from the lug 2. The upper wing 4*a* also has in an upper wall of the guide bore 16 a cutout 17 of a length L for receiving the closure projection 13. A compression spring 22 is received centrally in the guide bore 16 to normally urge the slide 10 toward the rear end of the slide body. The rearward movement of the slide 10 is restricted by a pair of stops 23, 24 disposed at the rear end of the upper wing 4*a* and projecting into the guide bore 16. The slide 10 has in its one end has a central recess W receptive of one end portion of the spring 22.

In production, the slider body is made by die casting and initially has a pair of upwardly directed protuberances 23', 24' (FIG. 4) at the rear end of the upper wing 4a near the guide bore 16. Then, after the spring 22 and the slide 10 have been inserted in the guide bore 16, the two protuberances 23', 24' are bent into the guide bore 16 to provide the respective stops 23, 24, as shown in FIG. 5. Subsequently, the slide 10 is moved from its closed position (FIG. 5) to its open position (FIG. 3) against the bias of the spring 22 by simply pushing the closure projection 13 by the pintle 8 of the pull tab 3. The pull tab 3 is then threaded onto the lug 2, whereupon the slide 10 returns to its closed position (FIG. 1) under the bias of the spring 22 in which position the closure projection 13 is disposed in vertical alignment with the free end 7 of the lug 2 to thereby prevent the pull tab 3 from accidental removal from the lug 2.

Figure 3:
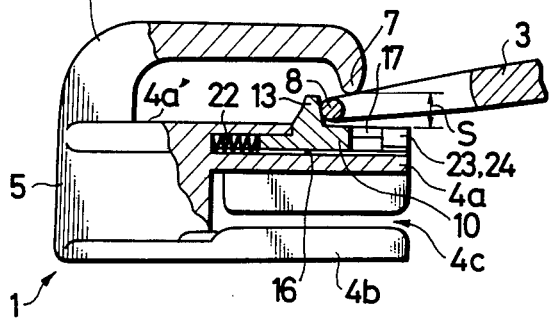
FIG. 3 is a view similar to FIG. 1, showing the manner in which a pull tab is attached.

To detach the pull tab 3 from the slider 1, the slide 10 is manually moved against the bias of the spring 22 from the position of FIG. 1 to the position of FIG. 3 in which the closure projection 13 is spaced from the free end 7 of the lug 2 to allow the pintle 8 of the pull tab 3 to pass through the gap S.

Figure 4:
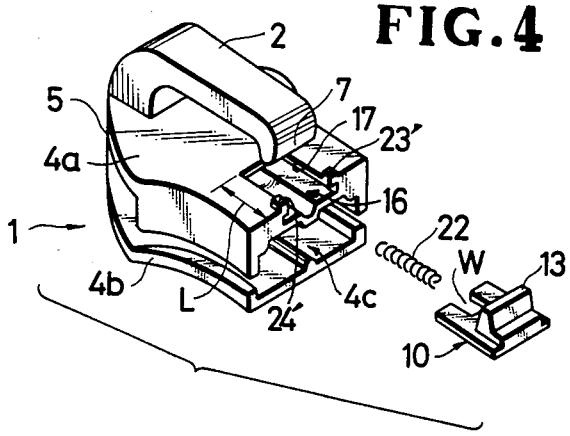
FIG. 4 is an exploded perspective view of FIG. 1, showing the slider before it has been assemblied.
Figure 5:
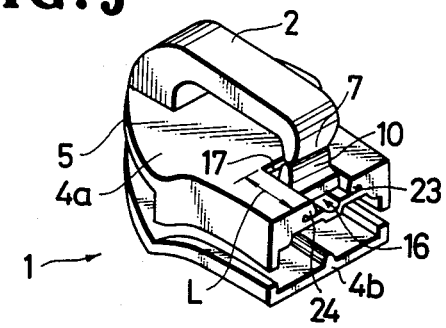
FIG. 5 is a perspective view of FIG. 1, showing the slider after it has been assemblied.
Figure 6:
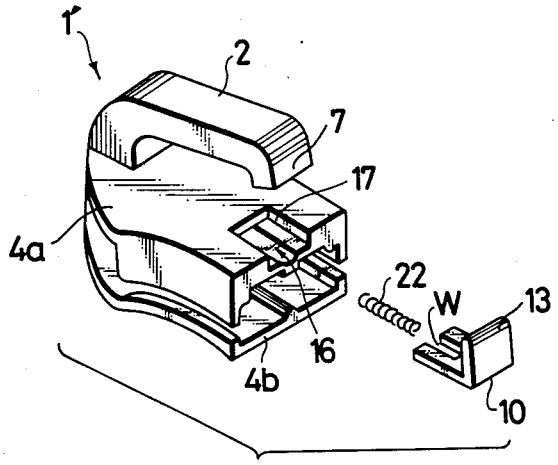
FIG. 6 is an exploded perspective view of a modified slider.
Figure 7:
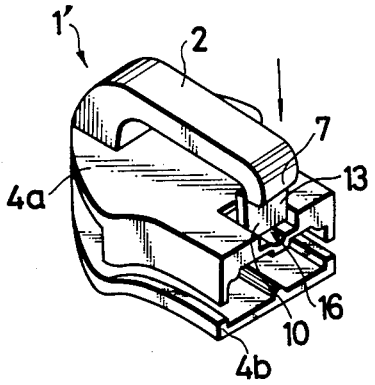
FIG. 7 is a perspective view of FIG. 6, showing the modified slider after it has been assemblied.

FIGS. 6 and 7 are views similar to FIGS. 4 and 5, but illustrating a modified slider 1' which is different from the previous embodiment only in that the rearward movement of the slide 10 is restricted by the free end 7 of the lug 2, instead of the stops 23, 24 (FIGS. 1, 3 and 5). As the slide 10 is disposed in closed position, the closure projection 13 is disposed against the inner side of the free end 7 of the lug 2 under the bias of the spring 22. In production, the gap between the free end 7 of the lug 2 and the top surface 4a' of the upper wing 4a is initially large enough to allow the slide 10 to be inserted into the guide bore 16, at which time the closure projection 13 can pass the free end 7 of the lug 2. After the slide 10 together with the spring 22 is inserted in the guide bore 16 until the closure projection 13 has passed the free end 7 of the lug 2, the lug 2 is then bent or deformed in such a manner that the free end 7 of the lug 2 is disposed below the top end of the closure projection 13 and is spaced from the top surface 4a' of the upper wing 4a by the predetermined gap S larger than the diameter of the pintle 8 of the pull tab 3.

In any of the embodiments described above, the pull tab 2 can maintain its proper orientation even when it is pulled, because the pintle 8 of the pull tab 2 is no longer engaged or caught by the spring 22.

Another advantage of the slider 1 is that the individual components of a pull-tab retainer, i.e. the spring 22 and the slide 10, can maintain their proper postures stably after the slider 1 has been assemblied, thus enabling automated assembling. Further, since there is no separation in the central portion of the lug 2, the slider 1 is neat in appearance.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A slider for a slide fastener having a pair of opposed coupling element rows, comprising:

(a) a slider body including upper and lower wings joined at their front ends by a neck so as to define a Y-shaped guide channel between said upper and lower wings for the passage of the opposed coupling element rows;

(b) an arch-shaped lug projecting from the front end of said upper wing over a top surface of said upper wing and terminating in a rear free end directed toward said top surface of said upper wing and spaced therefrom by a predetermined gap;

(c) a pull tab threaded onto said arch-shaped lug for pivotal movement relative to said slider body and having a pintle;

(d) a slide slidably mounted in said upper wing and having a closure projection, said slide being movable longitudinally of said slider body between an open position in which said closure projection is spaced from said rear free end of said arch-shaped lug so as to allow said pintle of said pull tab to pass through said gap, and a closed position in which said closure projection is disposed adjacent to said rear free end of said arch-shaped lug to prevent said pintle of said pull tab from passing through said gap; and (e) a spring mounted in said upper wing to normally urge said slide toward said closed position.

2. A slider for a slide fastener having a pair of opposed coupling element rows, comprising:

(a) a slider body including upper and lower wings joined at their front ends by a neck so as to define a Y-shaped guide channel between said upper and lower wings for the passage ofthe opposed coupling element rows, said slider body having a guide bore extending longitudinally in said upper wing from its rear end and terminating short of its front end, said upper wing having a cutout in an upper wall of said guide bore;

(b) an arch-shaped lug projecting from the front end of said upper wing over a top surface of said upper wing and terminating in a rear free end directed toward said top surface of said upper wing and spaced therefrom by a predetermined gap;

(c) a pull tab threaded onto said arch-shaped lug for pivotal movement relative to said slider body and having a pintle;

(d) a slide slidably mounted in said guide bore of said upper wing and having a closure projection through said cutout, said slide being movable longitudinally of said slider body between an open position in which said closure projection is spaced from said rear free end of said arch-shaped lug so as to allow said pintle of said pull tab to pass through said gap, and a closed position in which said closure projection is disposed adjacent to said rear free end of said arch-shaped lug to prevent said pintle of said pull tab from passing through said gap; and (e) a spring mounted in said guide bore of said upper wing to normally urge said slide toward said closed position.

3. A slide fastener slider according to claim 2, said closure projection being disposed in alignment with said rear free end of said arch-shaped lug in a direction perpendicular to said top surface of said upper wing when said slide is disposed in said closed position.

4. A slide fastener slider according to claim 3, said closure projection extending beyond said top surface of said upper wing to an extent slightly smaller than said gap.

5. A slide fastener slider according to claim 3, said closure projection being disposed against said rear free end of said arch-shaped lug under the bias of said spring when said slide is disposed in said closed position.

6. A slide fastener slider according to claim 5, said closure projection extending beyond said top surface of said upper wing to an extent larger than said gap.

7. A slide fastener slider according to claim 2, said slider body having at least one stop disposed at the rear end of said upper wing and projecting into said guide bore for preventing said slide from being removed from said guide bore.

* * * * *